United States Patent [19]

Levine

[11] 4,365,805

[45] Dec. 28, 1982

[54] SYSTEM FOR MONITORING TENNIS COURT BOUNDARY LINES

[76] Inventor: Carl Levine, 17214 Merlot Pl., Poway, Calif. 92064

[21] Appl. No.: 217,431

[22] Filed: Dec. 17, 1980

[51] Int. Cl.[3] ..... A63B 61/00

[52] U.S. Cl. ..... 273/31; 340/323 R

[58] Field of Search ..... 273/31, 374, 29 R, 50; 340/323 R; 434/339

[56] References Cited

U.S. PATENT DOCUMENTS

| | | | |
|---|---|---|---|
| 2,709,592 | 5/1955 | McAvoy | 273/102.2 |
| 3,341,204 | 9/1967 | McDannold | 273/102.2 |
| 3,415,517 | 12/1968 | Krist | 273/31 |
| 3,492,440 | 1/1970 | Cerbone et al. | 179/90 |
| 3,774,194 | 11/1973 | Jokay et al. | 340/323 |
| 3,810,148 | 5/1974 | Karsten et al. | 340/323 |
| 3,854,719 | 12/1974 | Supran | 273/29 R |
| 3,883,860 | 5/1975 | von Kohorn | 340/323 |
| 3,982,759 | 9/1976 | Grant | 273/31 |
| 4,014,546 | 3/1977 | Steinkamp | 273/374 |
| 4,062,008 | 12/1977 | Carlsson et al. | 340/323 R |
| 4,071,691 | 1/1978 | Pepper | 273/DIG. 28 |
| 4,092,634 | 5/1978 | von Kohorn | 340/323 R |
| 4,109,911 | 8/1973 | Van Auken | 273/31 |
| 4,222,563 | 9/1980 | Heftler et al. | 273/29 A |

FOREIGN PATENT DOCUMENTS

| | | | |
|---|---|---|---|
| 1234083 | 6/1971 | United Kingdom . | |
| 1370332 | 10/1974 | United Kingdom | 273/29 R |

*Primary Examiner*—Vance Y. Hum
*Assistant Examiner*—Leo P. Picard
*Attorney, Agent, or Firm*—Brown & Martin

[57] ABSTRACT

A system for aiding a person in determining whether a ball has struck one of a plurality of boundary lines of a playing court. A plurality of laminated, pressure sensitive contact type switches extend along the boundary lines of the court. Digital circuitry connected to the switches repeatedly examines the status of the switches before and after the closure of any one of the switches to determine if the closure lasted for a predetermined time interval, e.g., more than 800 microseconds and less than 5 milliseconds, and therefore resulted from the impact of a ball. A plurality of resistors interconnect the switches so that the simultaneous closure of any pair of switches by a player's foot and the ball will uniquely determine a plurality of resistor networks. The amplitudes of the currents in the networks are determined by a measuring circuit which outputs signals that enable logic circuitry to determine the location on the court where the impact of the ball has occurred. Driver circuitry connected to the logic circuitry activates visual and audio indicators which aid a person in determining that the ball has struck a boundary line at a particular location.

10 Claims, 7 Drawing Figures

SYSTEM FOR MONITORING TENNIS COURT BOUNDARY LINES

BACKGROUND OF THE INVENTION

In tennis, as the skill of a player matures, the speed of travel of the ball increases and more and more "close calls" decide matches. On a random probability basis, it is typical to have five percent of all services and volleys in a match decided by balls striking boundary service, base and center lines. A judge linesman, player or observer may well have to determine in less than a blink of the eye whether a tennis ball was "in" or "out". In fact, at a horizontal velocity of 100 miles per hour (approximately 1,716 inches per second) the tennis ball travels across the width of the court's marking tape in approximately one-thousandth of a second. This is more than one-hundred times faster than the time it takes for the human eye to blink. It is thus apparent to even a casual observer, let alone judges and umpires, that the human senses alone are inadequate to accurately discern whether a tennis ball is still in play or not.

Heretofore, a number of devices have been proposed to overcome the aforementioned problem. However, to date, none of these devices has gained significant acceptance by the tennis community. For example, devices utilizing photo electric or infrared eyes have been developed, however, they suffer from cost disadvantages and player "black-outs" and "shadowing" of the tennis ball's trajectory. Devices have also been constructed which have utilized pneumatic components, but these devices are not attractive because their bulk affects the conduct of play. Self marking substances such as chalk lead to controversies over when the mark on the court or the ball occurred.

U.S. Pat. No. 3,854,719 issued to Supran; U.S. Pat. No. 3,883,860, issued to von Kohorn; U.S. Pat. No. 4,092,634, von Kohorn; and U.S. Pat. No. 4,109,911, issued to Van Auken disclose the concept of utilizing conductive elements on a tennis ball and on a tennis court playing surface to actuate visual and audio signals indictative of where the ball strikes the surface. Such systems require undesirable modification of a conventional tennis ball.

U.S. Pat. No. 3,810,148 issued to Karsten et al discloses a tennis court monitoring system in which a transmitter sends a pulsed beam of light at periodic intervals along a boundary line. A receiver senses the pulsed beam of light, and a control circuit detects the interruption of the beam. The control circuit discriminates between short duration interruptions caused by a permissible event such as a tennis ball landing on the line, and long duration interruptions caused by an impermissible event such as a server's foot landing on the service line. This system involves complicated optics and requires precise aiming of the beam.

U.S. Pat. No. 3,415,517 issued to Krist discloses a tennis court monitoring system which utilizes impact conductors that extend under selected boundaries and areas of a tennis court. Transducers such as piezoelectric crystal microphones are connected to the impact conductors for converting an impact into a signal which operates as indicator-detector to aid an umpire in judging a match. Impact conductors and transducers are also associated with the tennis net for detecting and indicating an impact thereon. This system requires numerous conductors to be embedded in the court. Also, it would seem that analog signals from the microphones generated by a ball and foot would be difficult to discriminate.

U.S. Pat. No. 3,774,194 issued to Jokay et al discloses a tennis court monitoring system in which a modified tennis ball carrying antenna coils interacts with magnetic fields emanating from the tennis court surface so that receiver circuitry can detect the location at which the tennis ball strikes the surface. The utilization of RF receivers leads to noise, tuning, and sensitivity problems.

U.S. Pat. No. 4,062,008 issued to Carlsson et al discloses a tennis court monitoring system in which pressure sensitive switches of the capacitor type define the boundaries of the tennis court. The distance between the plates in the capacitor type switches as well as the dynamic spring rate of the elastic material between the plates is adjusted to detect ball bounces and not foot impacts. When a tennis ball hits one of the switches on a boundary line, the change of capacitance causes a change of voltage across the capacitor. This voltage change is sensed by an indicator unit including an amplifier which amplifies pulses from the switch. A monostable multi-vibrator connected to the output of the amplifier has a change-over time which determines the duration of light and audio signals indicating the impact of a ball on the boundary line. Adjusting the capacitor switches to enable reliable discrimination between ball and foot impacts would be difficult in this system.

U.S. Pat. No. 3,982,759 issued to Grant discloses a tennis court line monitoring apparatus in which a pair of parallel pressure sensitive switches of the capacitor type respectively extend over, and outside of, a boundary line of a tennis court. The pair of switches are connected to a circuit including a pair of linear integrated monolithic timing circuits which in turn cause a lamp and buzzer to be activated if the tennis ball strikes the out of bounds one of the switches. The circuitry times the duration of the closing of the switches so that if a player merely steps on the out of bounds one of the switches the lamp and buzzer are not activated. The bouncing of a tennis ball off of the in bounds one of the switches inhibits the timing circuitry so that the lamp and buzzer are not activated even though the ball subsequently closes the out of bounds one of the switches.

The Grant patent also discloses circuitry for placing the system in a foot foul detection mode. In this mode the closing of one of the pressure sensitive switches prior to a microphone receiving an acoustic pick-up of the sound of a tennis ball being struck results in an indication to the linesman that a foot fault has occurred.

The Grant patent appears to disclose the possible utilization of a contact type pressure sensitive switches. Grant recognizes that in his system which utilizes capacitor type switches if a player is standing on a line, the hitting of the line by a ball is not detected. However, Grant indicates that this can be overcome by installing separate switching circuits of suitable length along a single boundary line. Thus, a considerable duplication of switches would be required. Furthermore, while not mentioned by Grant, such multiple switches would necessitate the utilization of multiple timing circuits or multiplexer circuitry.

In the Grant system, whether contact type or capacitor type pressure sensitive switches are utilized oscillation after impact will occur since the layer of material between the conductors is resilent. Thus, even after the tennis ball or the player's foot has impacted the switch, the detector circuitry will receive repeated pulses or variations in capacitance. The circuitry described in Grant does not appear to be adapted for discriminating between signals representative of the impact of a ball or foot on the one hand, and spurious signals on the other hand.

Also of general interest in this field, although of less pertinence than the patents already discussed, are U.S. Pat. No. 2,709,592 issued to McAvoy; U.S. Pat. No. 3,341,204 issued to McDannold; U.S. Pat. No. 3,492,440 issued to Cerbone et al; and British Pat. No. 1,234,083 issued to National Research Development Corporation.

SUMMARY OF THE INVENTION

It is therefore the primary object of the present invention to provide a system for aiding a person in making line calls which does not materially affect the conduct of play.

It is a further object of the present invention to provide a system of the aforementioned type that can reliably distinguish between a tennis ball and a player's foot.

A still further object of the present invention is to provide a system of the aforementioned type which does not allow a player to "mask" or "shadow" the impact of the tennis ball.

The present invention provides a system for aiding a judge, player, linesman or observer in determining whether a ball has struck one of a plurality of boundary lines of a playing court. A plurality of laminated, pressure sensitive contact type switches extend along the boundary lines of the court. Digital circuitry connected to the switches repeatedly examines the status of the switches before and after the closure of any one of the switches to determine if the closure lasted for a predetermined time interval, e.g., more than 800 microseconds and less than 5 milliseconds. and therefore resulted from the impact of a ball. A plurality of resistors interconnect the switches. The closure of any pair of switches by a player's foot and the ball will result in a unique plurality of resistor networks. The amplitudes of the currents in the networks are determined by a measuring circuit which outputs signals that enable logic circuitry to determine the location on the court where the impact of the ball has occurred. Driver circuitry connected to the logic circuitry activates visual and audio indicators which aid a person in determining that the ball has struck a boundary line at a particular location.

BRIEF DESCRIPTION OF THE DRAWINGS

Throughout the Figures, like reference numerals refer to like parts unless otherwise indicated.

DESCRIPTION OF THE PREFERRED EMBODIMENT

Figure 1:
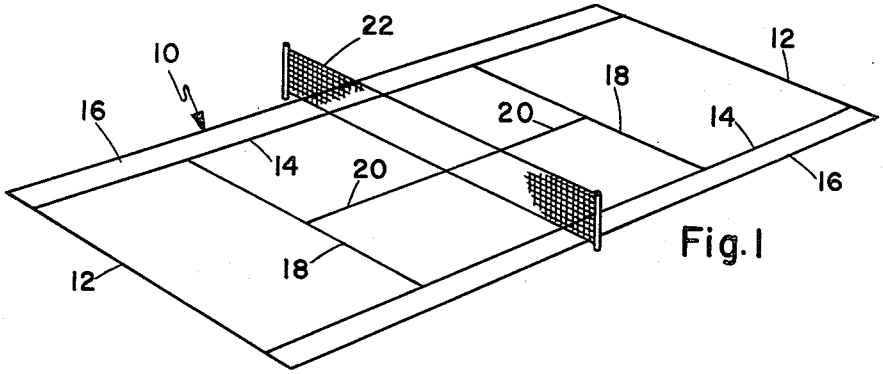
FIG. 1 is a perspective view of a tennis court illustrating the placement of the pressure sensitive switches which form a part of the present invention.

Referring to FIG. 1, there is illustrated therein a tennis court 10 having the conventional layout of boundary lines including base lines 12, singles play side lines 14, doubles play side lines 16, as well as service lines 18 and 20 and a net 22. The boundary of a tennis court during singles play is determined by the base lines 12 and the side lines 14. The boundary of a tennis court during doubles play is determined by the base lines 12 and the side lines 16.

According to the present invention, contact type pressure sensitive switches hereafter described preferably extend on top of the court surface along at least the base lines 12 and the side lines 14 and 16. These switches are connected to circuitry hereafter described to aid the judge, linesman, player or observer in determining whether a tennis ball is still in play. More specifically, on a return shot, if a tennis ball strikes one of the base lines 12 or one of the side lines 14 and 16, depending upon whether a singles match or a doubles match is in process, one of the switches associated with that boundary line will send a signal to the circuitry which in turn activates audio and/or visual indicators.

Usually a person can readily determine that a return shot has landed inside of the base line or the appropriate side line for that side of the court. It is far more difficult, however, for a person to determine whether a ball has struck one of the boundary lines and is therefore still in play, or whether the ball has landed outside the boundary line and is therefore no longer in play. The system of the present invention will aid a person in making close calls of the former type by providing audio and/or visual indications if the ball has struck a boundary line.

While not specifically described herein, it will be readily understood that the system of the present invention may be expanded to aid a person in determining service faults by providing audio and/or visual indications if the ball has struck the boundary lines 18 and 20 (FIG. 1) of the proper service court area. This requires additional pressure sensitive switches on the surface of the court extending along the service lines 18 and 20.

The system of the present invention is adapted for discriminating between a tennis ball and a player's foot. In addition, the system is designed to do this while a player is standing on a boundary line and a ball strikes the same boundary line.

Figure 2:
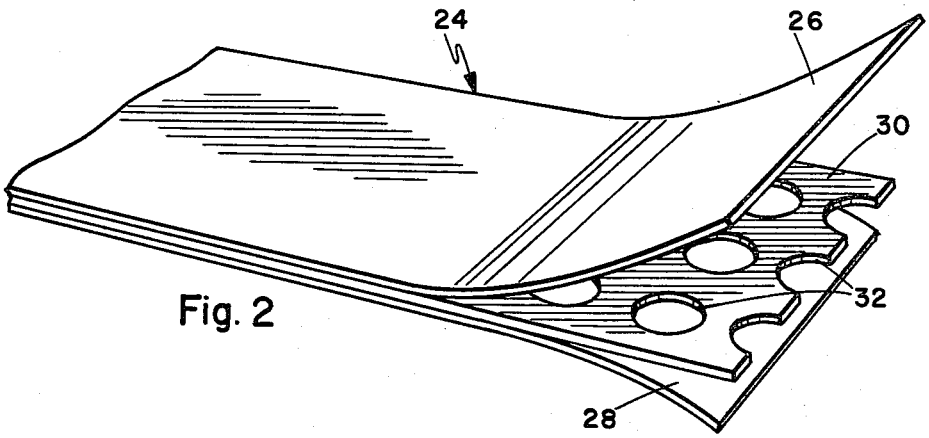
FIG. 2 is an enlarged view of a delaminated portion of one of the pressure sensitive switches.

FIG. 2 illustrates the construction of a portion of one of the contact type pressure sensitive switches 24. Each such switch has a laminate construction including upper and lower layers 26 and 28 made of an electrically conductive material. An inner perforated layer 30 made of an insulative or non-electrically conductive material is sandwiched between the upper and lower conductive layers. Preferably, the pressure sensitive switch is very thin so that when it is affixed to the top surface of the tennis court over selected boundary lines thereof, it will not materially affect the conduct of play. For example, preferably the pressure sensitive switches 24 having thickness of less than 0.040 inches. Preferably, the width of the layers 26, 28 and 30 equals the width of the standard tennis court boundary line over which it is affixed, e.g., two or four inches.

The upper and lower conductive layers 26 and 28 (FIG. 2) may be made of very thin metal such as aluminum foil affixed to a resilient material. The inner layer 30 is preferably made of a nondeforming plastic material such as that sold under the trademarks NYLON, MYLAR or TEFLON. The inner layer is preferably perforated with a plurality of perforations such as round holes 32. The layers 26 and 28 are positioned with their conductive surfaces facing the perforated inner layer. When an object such as a player's foot or a tennis ball strikes the upper conductive layer 26 of the switch with sufficient force or pressure, the upper layer will penetrate and extend through certain ones of the holes 32 in the area of impact and will make physical contact with the lower conductive layer 28. In this manner, when the upper and lower conductive layers 26 and 28 are connected to an electrical power source and ground, respectively, the upper and lower layers 26 and 28 are connected in series and current can conduct therethrough. The electron flow can then be used as an indicator of when physical force in excess of a predetermined amount has been applied to the switch.

By selecting the proper materials and thicknesses for the layers 26, 28 and 30 of the switch 24 and by properly dimensioning and arranging the perforations 32 in the inner layer, the minimum closure force for the switch can be selected so that the switch will close in response to a wide range of tennis ball vertical impact velocities normally encountered during play. Thus, an accurate impact area-time profile can be produced by the switch. The typical time-pressure profile of the impact of a tennis ball during play is approximately sixteen pounds per square inch for a total impact period of approximately one to five milliseconds. Thus, the switch 24 can be constructed with significant stiffness to both extend the switch's useful life and conform to the surface hardness of a tennis court, while at the same time permitting the switch to accurately detect the impact of a tennis ball thereon. If the pressure-time profile was not this pronounced, then the switch would have to be made thinner and/or more compressible, making the life of the switch short and such a system economically prohibitive.

During play, a tennis ball has resultant vertical velocity vectors that are sufficient to deform the tennis ball on impact with the tennis court surface. This area of impact is generally circular with a diameter of between one-half and one and one-half inches. Preferably, the diameter of the holes 32 is at most one-quarter the size of the minimum tennis ball imprint diameter. In the example given, preferably the maximum diameter of the holes 32 in the inner layer 30 of each of the switches is approximately one-eighth of an inch. This relationship will insure that the upper layer 24 deforms sufficiently through at least one of the holes 32 to contact the conductive surface of the lower layer 26. Though not depicted in FIG. 2, some of the perforations 32 form recesses in the side edges of the layer 30 to insure that a tennis ball striking the edge of the switch tape 24 will cause the upper and lower conductive surfaces of the layers 26 and 28 to contact each other.

A player's foot impact on the switch 24 can readily be distinguished from a tennis ball impact because of their different time-pressure profiles. Typically, the minimum player time expended on the switch will cause switch closures that exceed 100 milliseconds. Kicking the switch may cause the upper and lower conductive layers to oscillate toward and away from each other over a time interval typically in excess of 100 milliseconds during which multiple contacts may be made between the upper and lower conductive layers 26 and 28, each contact typically lasting more than 800 microseconds and less than 5 milliseconds, thereby imitating the time-pressure profile of a tennis ball.

Thus, the events immediately preceding and following a switch closure of interest must be examined to discern a tennis ball from a vibrating switch caused by a foot kicking the switch. The system of the present invention includes an electronic circuit hereafter described which examines the time duration of the current produced by the switch closures. If the duration is longer than approximately 800 microseconds, and less than 5 milliseconds, and if no other event or activity, i.e., switch closure, has taken place 100 milliseconds prior to and after the subject switch closure, then there is a high probability that the switch has been struck by a tennis ball.

Figure 3:
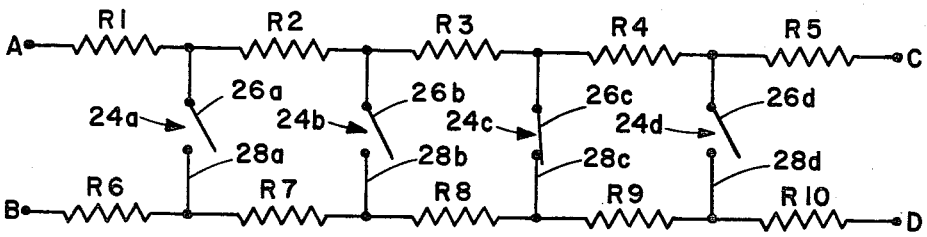
FIGS. 3 and 4 are schematic diagrams illustrating the manner in which a plurality of the pressure sensitive switches may be connected to prevent a player from masking the impact of a tennis ball on a boundary line of the tennis court.
Figure 4:
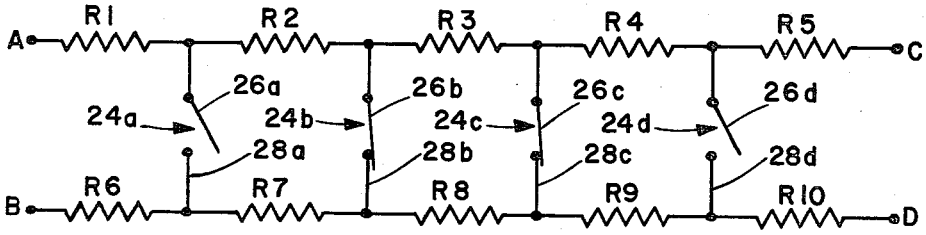

The system of the present invention is further adapted to prevent a player from "masking" or "shadowing" the impact of the tennis ball. This can take place if the player, during the impact time of a tennis ball with one of the boundary lines, is standing, running or kicking the same line. As illustrated in FIGS. 3 and 4, the foregoing condition is prevented by providing each of the switch segments which comprise the boundary lines of the tennis court which are being monitored with a plurality of the relatively short switches 24 arranged in end to end configuration. The conductive layers of these small switches 24 are connected in series with thin film resistors or resistive wires. Furthermore, the circuit hereafter described incorporates circuitry for measuring the resistances caused by the closure of a particular switch. By connecting the switches with resistors as illustrated, a switch closure no longer results in a complete electrical short and instead yields a means of determining the physical location of the impact points of a foot and a ball. This arrangement also prevents a player's foot from masking the ball's impact with a boundary or service line.

For the sake of simplicity, in FIG. 3 only four switches **24*a*, 24*b*, 24*c* and 24*d* have been illustrated. However, it will be understood that in the actual embodiment of the invention, many such switches are interconnected for each of the boundary lines being monitored. Preferably, the length of each one of the switches 24** is small enough so that only in rare instances would a player's foot and the tennis ball simultaneously strike the same switch.

Referring again to FIG. 3, the upper conductive layers **26*a*, 26*b*, 26*c* and 26*d* of each of the four switches are connected to each other and to the terminals A and C by resistors R1, R2, R3, R4 and R5. Similarly, the lower conductive layers 28*a*, 28*b*, 28*c* and 28*d* of each of the four switches are connected to each other and to the terminals B and D by resistors R6, R7, R8, R9 and R10**.

As an example, a tennis ball striking the switch **24*c* (FIG. 3) will cause the conductive layers 26*c* and 28*c* thereof to contact each other as indicated schematically in FIG. 3. When the terminals A and C are connected to a common electrical power source and the terminals B and D are connected to ground, closure of the switch 24*c*** will cause current through resistor networks AB, AD and CD. The amplitude of the current flowing through each of the last mentioned networks is determined by the total value of the resistors in each network. Therefore, the current amplitude in the networks AB, AD and CD can be utilized to determine the physical position on the tennis court where the tennis ball struck one of the monitored boundary lines.

When a player is standing on a boundary line while a tennis ball strikes the same line, typically the player's foot and the tennis ball may cause different switches to be simultaneously closed. As previously mentioned, the individual switches which are connected in end to end fashion along a boundary line preferably have a relatively short length so that in most instances a player's foot and the tennis ball will not strike the same switch at the same time.

Assume that a player is standing on the switch 24*b* when a tennis ball strikes the switch 24*c* as shown schematically in FIG. 4. The amplitude of the current through the resistor networks AB, AD and CD can still be used to determine the physical location at which the tennis ball struck a boundary line of the tennis court, since the circuitry hereafter described is capable of recognizing that a player is standing on the switch 24*b*. It should be pointed out, that the resistance value of the individual resistors must be large enough to generate a sufficient voltage drop across the same in the case where a switch near the end of a boundary line, such as the switch 24*d* in FIG. 3, is closed. A sufficient voltage drop is necessary in order for the analog portion of the circuitry hereafter described to determine that the last switch in a line of switches has been closed.

Figure 5:
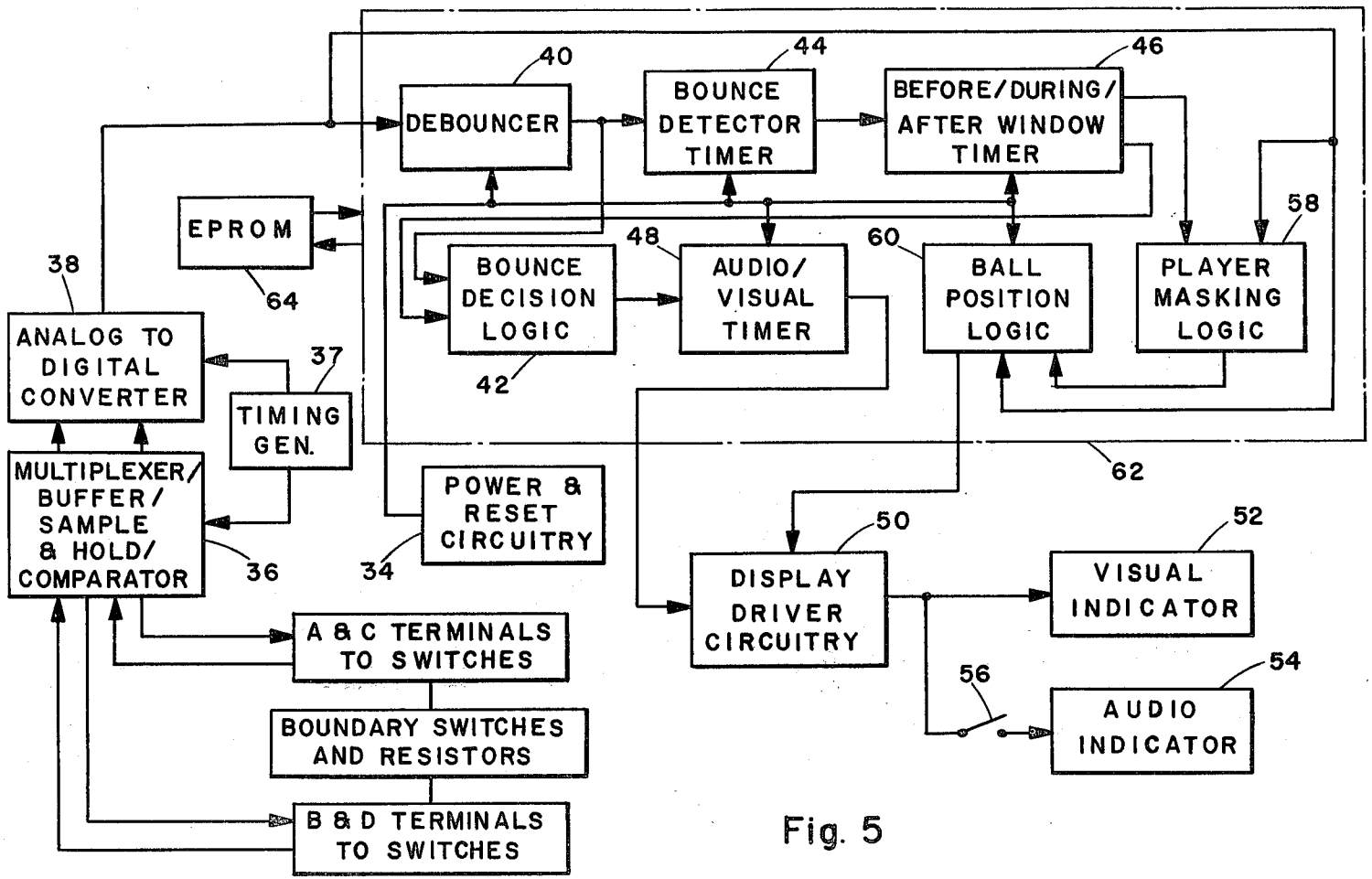
FIG. 5 is a functional block diagram of a first embodiment of a circuit which may form a part of the present invention.

In the actual system, all of the switches 24 for the base and side boundary lines may be connected between the four terminals A, B, C and D as illustrated in FIGS. 3 and 4, there being hundreds of such switches. Various arrangements and combinations of service and boundary lines may be utilized. By way of example, the boundary lines may be arrayed in for the left and right sides of the court depicted in FIG. 1 on separate A, B, C and D terminals. The service lines may be arrayed in on another set of A, B, C and D terminals. The terminals A and C are connected to a suitable electrical power source included in a power and reset circuitry 34 (FIG. 5). The A and C terminals are connected to the B and D terminals only upon closure of the various switches 24 as illustrated and described in connection with FIGS. 3 and 4.

Referring to FIG. 5, the A, C, B and D terminals are connected to a multiplexer/buffer/sample and hold-/comparator circuit 36 which time samples, via multiplexing, the voltage across terminals A, B, C and D. The sample and hold functions of the circuit 36 enable the storage of these analog voltages which are representative of the physical locations of the switch closures. A timing generator 37 provides the necessary multiplexing scanning sampling rates as well as the reference voltage level for the comparator portion of the circuit 36. That portion periodically compares the reference voltage against the sample and hold voltage. The difference analog voltage signal is outputed from the circuit 36 to an analog to digital converter 38 for conversion into a digital state before being transmitted to a digital debouncer 40.

Upon the closure of one of the switches 24, the debouncer 40, which includes a shift register, examines the duration of the switch closure. A clock phase count is initiated. If the switch is still closed after a predetermined interval of time has elapsed, preferably 800 microseconds, then a voltage state change is outputted to a bounce decision logic 42. The 800 microsecond time limit has been derived from experimentation. It reflects the minimum time of impact of a tennis ball with the surface of a tennis court during play.

While the debouncer 40 (FIG. 5) is determining the minimum switch closure time for a tennis ball, a bounce detector timer 44 establishes the maximum impact time, preferably 5 milliseconds, for a tennis ball. Experimentation has indicated that 5 milliseconds is the maximum impact duration of a tennis ball with the surface of a tennis court during play. If within 5 milliseconds of the initial switch closure, which has been manifested as a digital state change iniating from the A to D converter 38 through the debouncer 40 to the bounce detector timer 44, the switch returns to an open condition, a voltage state change occurs at the input of a before/-during/after window timer 46. Note that the debouncer 40 has indicated to the bounce decision logic 42 that the switch closure has exceeded 800 microseconds. Now the bounce detector timer 44 has determined that the switch closure has not exceeded 5 milliseconds. It now remains for the before/during/after window timer 46 to examine the time intervals immediately preceding, during, and after the 800 microsecond to 5 millisecond switch closure to decide whether a tennis ball has caused the switch closure. If it is determined that no other switch closures have taken place, a voltage state change will be outputted to the bounce decision logic 42.

The before/during/after window timer 46 continually examines the state of the pressure sensitive switch before, during and after any switch closure in excess of 800 microseconds but less than 5 milliseconds. This repeated re-examination is done at sub-millisecond intervals. If no additional closure of the switch has taken place 100 milliseconds prior to the closure and for 100 milliseconds after the initial closure, and the duration of the closure was more than 800 microseconds, but less than 5 milliseconds, then the system assumes that a tennis ball has caused the switch closure. This results in corresponding voltage state changes being outputted to the bounce decision logic 42.

The bounce decision logic 42 receives the aforementioned signals from the before/during/after window timer 46 and the debouncer 40 and outputs a signal to an audio/visual timer 48. The timer then turns on the display driver circuitry 50 for a predetermined time interval, for example 3 seconds. The display driver circuitry 50 operates a visual indicator 52, such as a panel having a plurality of LED's arranged to define the boundaries of the tennis court being monitored. The display driver circuitry 50 causes the illumination of a particular LED at a location representative of the point on the court where the tennis ball struck the boundary. In addition, the display driver circuitry 50 causes an audio indicator 54 to emit an audible tone indicating that the tennis ball has struck a boundary line. If desired, the audio indicator may be disconnected by opening a switch 56. The power and reset circuitry 34 prevents false triggering of the system by turn-on surges.

A player who causes one of the switches to close by standing on one of the boundary lines will be detected by the system so that the impact of the tennis ball on the same boundary line will not be masked or inhibited. When a player's foot and the tennis ball simultaneously close two separate switches 24, signals representative of the current through the various resultant resistor networks will be transmitted from the multiplexer/buffer/-sample and hold/comparator 36. These signals are transmitted through the analog to digital converter 38 and the debouncer 40 to a player masking logic 58.

The player masking logic 58 receives signals from the before/during/after window timer 46 and the output of the analog to digital converter 38 indicating which of the digital signals representing different current amplitudes have a duration between 800 microseconds and 5 milliseconds and are thus the result of a tennis ball impact. A ball position logic 60 analyzes the digital signals representing current values for the various networks determined by the tennis ball switch closure. This is done utilizing look-up tables containing predetermined information for uniquely determining the location of a ball impact based upon the current through the various networks determined by the corresponding switch closure. An EPROM 64 may be utilized for storing data concerning the relationship among switches, geographical/topographical positions and voltage/current information. The ball position logic 60 outputs signals to the display driver circuitry 50 to permit the latter to drive the visual indicator 52 so that it displays the location on the court at which the tennis ball struck a particular one of the boundary lines.

The circuit depicted in FIG. 5 may be of the dedicated type constructed from various discrete components and integrated circuit chips. Alternatively, the functions represented by the blocks 40, 42, 44, 46, 48, 58 and 60 may be performed by a suitable microprocessor 62 such as INTEL 8080 utilizing a microprogram stored in the EPROM 64.

Figure 6:
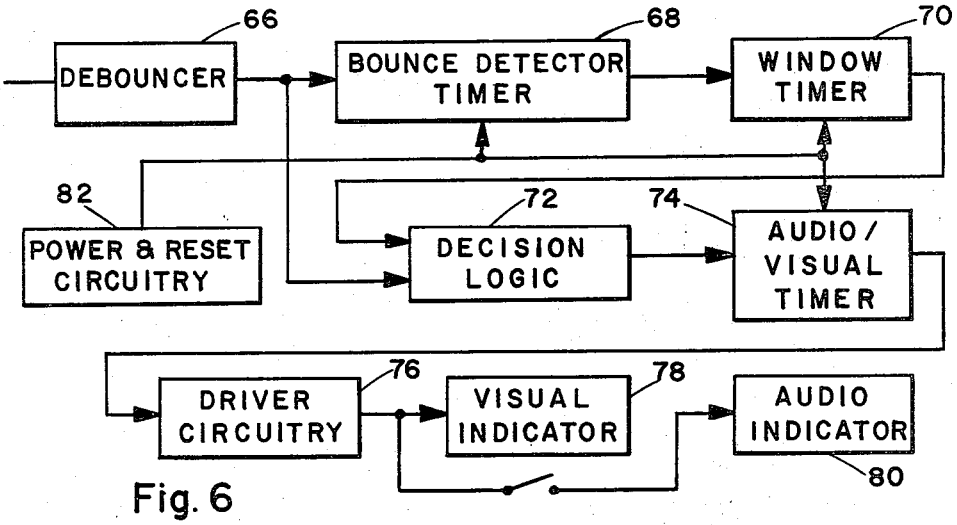
FIG. 6 is a functional block diagram of a second embodiment of a circuit which may form a part of the present invention.
Figure 7:
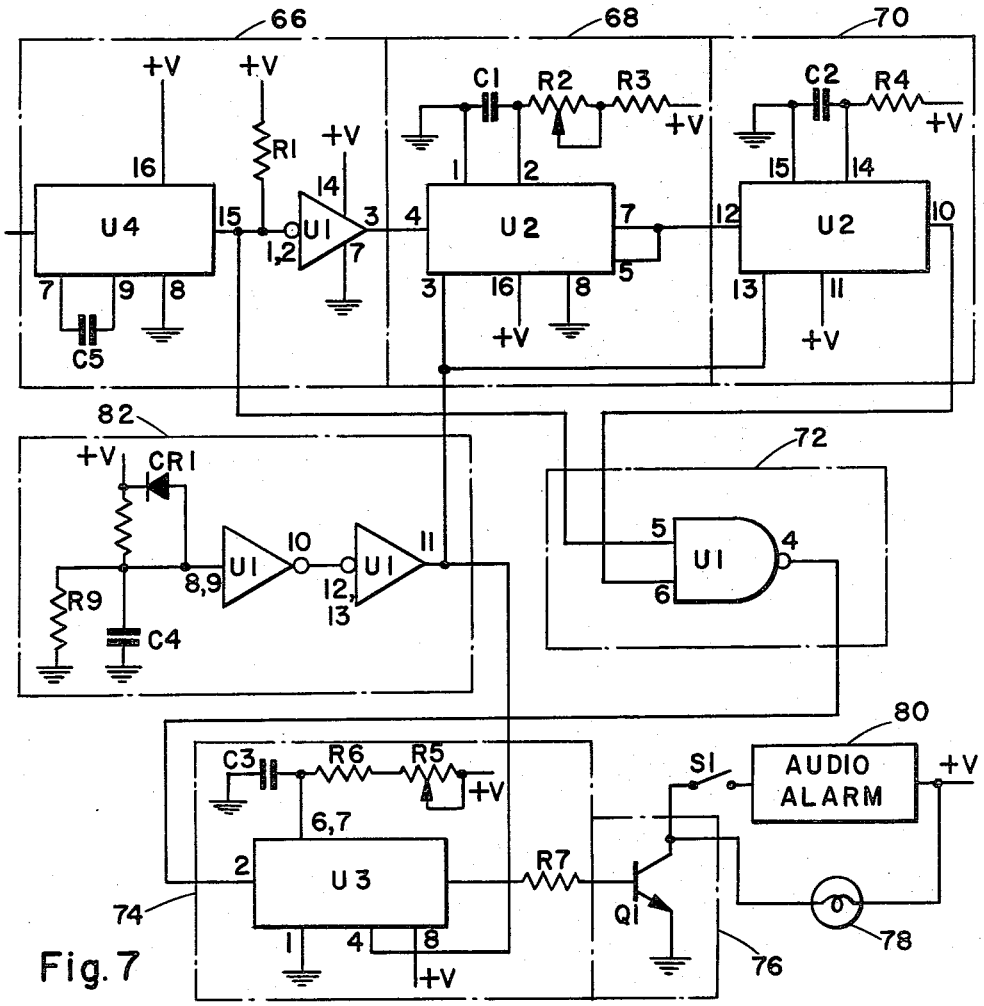
FIG. 7 is a schematic diagram of one version of the circuit illustrated in FIG. 6.

An alternative embodiment of a simplier circuit that may be utilized is shown in block diagram form in FIG. 6 and in schematic form in FIG. 7. The portions of the schematic circuit in FIG. 7 which correspond to the various functional blocks in FIG. 6 are outlined in phantom lines in FIG. 7 and marked with the corresponding reference numerals. In FIG. 7, the components U1 may be provided by a single chip of the type MC14011BCP. The components U2 may be provided by a single chip of the type MC14538BCP. The component U3 may be provided by a single chip of the type NE555N. The component U4 may be provided by a single chip of the type MC14490FP. The diode CR1 of the power and reset circuitry 82 may be type 1N914. The transistor Q1 of the driver circuitry 76 may be type MJE800. The audio alarm of the audio indicator 80 may be a MALLORY type SC12. The light bulb of the visual indicator 78 may be a twelve volt incandescent bulb.

The circuit illustrated in FIGS. 6 and 7 merely looks for an 800 microsecond to a 5 millisecond switch closure duration and does not examine 100 milliseconds before and after the switch closure. Furthermore, this circuit does not include the capability for preventing a player from masking detection of a ball striking a boundary line.

While preferred embodiments of the system of the present invention have been described and illustrated, it should be understood that my invention can be modified in arrangement and detail. Therefore, the protection afforded my invention should be limited only in accordance with the scope of the following claims.

I claim:

1. A system for aiding a person in determining whether a ball has struck one of a plurality of boundary lines of a playing court, comprising:

a plurality of switches extending along the boundary lines of the court, each switch including a perforated insulative layer sandwiched between upper and lower conductive layers, at least some of the layers being resilient and compressible to permit a switch closure in the form of a momentary contact between the conductive layers upon being impacted by the ball during play;

means for determining whether a switch closure resulted from a ball impacting one of the switches or from oscillations of the conductive layers of the switch toward and away from each other resulting from a foot kicking the switch, the determining means determines whether a switch closure under examination resulted from a ball impacting one of the switches by determining that the duration of the switch closure under examination is greater than a predetermined minimum duration and less than a predetermined maximum duration, and by further determining that no other switch closure occurred during predetermined time intervals before and after the switch closure under examination;

means for providing a predetermined minimum and maximum duration; and means for providing an indication to the person if a ball has struck the boundary line associated with the switch.

2. A system according to claim 1 wherein the perforated insulative layer has a plurality of round holes.

3. A system according to claim 1 and further comprising means for preventing the impact of a foot on one of the boundary lines from inhibiting the detection of the impact of a ball on the same boundary line.

4. A system according to claim 3 wherein each of the boundary lines has a plurality of individual switches extending in end to end fashion therealong, and further wherein the preventing means includes:

a first plurality of resistors each connecting the upper conductive layers of an adjacent pair of the switches; and a second plurality of resistors each connecting the lower conductive layers of an adjacent pair of the switches;

whereby the closure of any pair of the switches will uniquely determine a plurality of resistor networks.

5. A system according to claim 3 wherein the indication providing means gives the location on the court where the impact of a ball occurred.

6. A system according to claim 4 wherein the preventing means includes means for measuring the amplitudes of the currents through the plurality of resistor networks.

7. A system according to claim 6 wherein the preventing means further includes means for ascertaining the location of the ball impact based upon the output of the measuring means.

8. A system according to claim 1 wherein the predetermined minimum duration is approximately 800 microseconds and the predetermined maximum duration is approximately 5 milliseconds.

9. A system according to claim 1 wherein the predetermined time intervals are approximately 100 milliseconds long.

10. A system for aiding a person in determining whether a ball has struck one of a plurality of boundary lines of a playing court, comprising:

a plurality of switches extending along the boundary lines of the court, each switch including a perforated insulative layer sandwiched between upper and lower conductive layers, at least some of the layers being resilient and compressible to permit a switch closure in the form of a momentary contact between the conductive layers upon being impacted by the ball during play;

debouncer means for determining if the duration of a switch closure is greater than a predetermined minimum duration representative of a minimum time interval of the impact of a ball during play;

bouncer detector timer means for determining if the duration of the switch closure is less than a predetermined maximum duration representative of a maximum time interval of the impact of a ball during play;

window timer means for determining whether any other switch closure resulting from oscillations of the conductive layers of the switch toward and away from each other occurred during predetermined time intervals before and after the switch closure examined by the debouncer means and the bounce detector means; and bounce decision means responsive to the debouncer means, bounce detector timer means and window timer means for providing an indication to the person that the ball has impacted the boundary line if the duration of the switch closure is greater than the predetermined minimum duration and less than the predetermined maximum duration, and if no other switch closure occurred;

whereby switch closures resulting from a ball striking a boundary line may actuate indicator means to thereby be distinguished from switch closures caused by oscillations of the conductive layers of the switch associated with the boundary line resulting from a person kicking the switch.

* * * * *